US007323630B2

(12) United States Patent
Tsuge et al.

(10) Patent No.: US 7,323,630 B2
(45) Date of Patent: Jan. 29, 2008

(54) AUTOMATIC PERFORMANCE SYSTEM

(75) Inventors: Shinji Tsuge, Shizuoka (JP); Osamu Tamaishi, Shizuoka (JP)

(73) Assignee: Roland Corporation, Hamamatsu (JP)

( * ) Notice: Subject to any disclaimer, the term of this patent is extended or adjusted under 35 U.S.C. 154(b) by 412 days.

(21) Appl. No.: 10/757,070

(22) Filed: Jan. 14, 2004

(65) Prior Publication Data

US 2004/0159214 A1 Aug. 19, 2004

(30) Foreign Application Priority Data

Jan. 15, 2003 (JP) ..... 2003-006592

(51) Int. Cl.
*G10H 7/00* (2006.01)

(52) U.S. Cl. ..... 84/609; 84/649

(58) Field of Classification Search ..... 84/609, 84/611, 614, 634, 649, 650, 651
See application file for complete search history.

(56) References Cited

U.S. PATENT DOCUMENTS 4,300,430 A * 11/1981 Bione et al. ..... 84/477 R
4,506,580 A * 3/1985 Koike ..... 84/609
4,864,908 A * 9/1989 Kino ..... 84/638
5,650,583 A * 7/1997 Machover et al. ..... 84/626
5,696,343 A * 12/1997 Nakata ..... 84/609
5,739,456 A * 4/1998 Shimada ..... 84/622
6,051,771 A * 4/2000 Iizuka ..... 84/622

FOREIGN PATENT DOCUMENTS

| | | |
|---|---|---|
| JP | 03-192299 | 8/1991 |
| JP | 05-053577 | 3/1993 |
| JP | 07-199929 | 8/1995 |
| JP | 11-194768 | 7/1999 |

* cited by examiner

*Primary Examiner*—Lincoln Donovan
*Assistant Examiner*—David S. Warren
(74) *Attorney, Agent, or Firm*—Foley & Lardner LLP

(57) ABSTRACT

An automatic musical performance system stores musical data such as performance patterns and pattern sequences. During performance, the user provides input indicating tones to be added to or deleted from the musical performance, and the stored musical data is updated in accordance with the user input by adding or deleting the specified tones from the performance at the locations within the performance at which the user input for each tone was received.

23 Claims, 9 Drawing Sheets

AUTOMATIC PERFORMANCE SYSTEM

BACKGROUND OF THE INVENTION

1. Field of the Invention

Embodiments of the present invention relate systems for providing automatic performance of music.

2. Related Technology

A conventional automatic musical performance system stores a plurality of performance patterns. Each performance pattern comprises events defining musical tones and their timing, and each is typically one to two bars in length. The performance patterns are typically classified by musical genre. A composer may arrange a group of performance patterns to form a pattern sequence, and an automatic performance may be carried out by producing tones in accordance with the performance patterns of the pattern sequence. An example of such a system is provided in Japanese Unexamined Patent Application Publication (Kokai) Number 3-192299.

However, in this system it is difficult to edit the individual tones of a performance sequence. To do so, the composer or performer must rewrite an entire new performance pattern and substitute it for an existing performance pattern in the pattern sequence, even where it is desired to change only a single note. Since composition often involves trying many different variations until a desirable combination of notes is found, it is very time consuming to compose using this system.

SUMMARY OF THE INVENTION

Embodiments of the present invention improve over the aforementioned system by enabling the performer or composer to edit the patterns of notes in a pattern sequence with little effort compared to that required by the aforementioned system.

In accordance with embodiments of the invention, the user provides input during performance indicating tones to be added to or deleted from the musical performance. This causes the data representing the musical performance to be updated by adding or deleting the specified tones from the performance at the locations within the performance at which the user input for each tone was received.

In accordance with one embodiment, a device includes operators that represent various tones such as musical notes or percussive sounds. During performance of a pattern sequence, the user uses the operators to indicate notes that should be added and the points at which they are added, as well as notes to be deleted. In response to this input, a new performance pattern is created from the performance pattern of the pattern sequence that is being executed when the input is received. The new performance pattern includes the added notes and does not included the deleted notes. The pattern sequence is then updated to substitute the pattern identifier of the new performance pattern in place of the pattern identifier of the performance pattern from which it was created. Consequently the pattern sequence is updated in a simple intuitive manner.

DESCRIPTION OF THE DRAWINGS

FIG. 6(*a*) shows the pattern sequence data before the change and FIG. 6(*b*) shows the pattern sequence data after a partial change;

FIG. 9(*a*) shows the pattern sequence data before the change and FIG. 9(*b*) shows the pattern sequence data after a partial change.

DETAILED DESCRIPTION OF PREFERRED EMBODIMENTS

Figure 1:
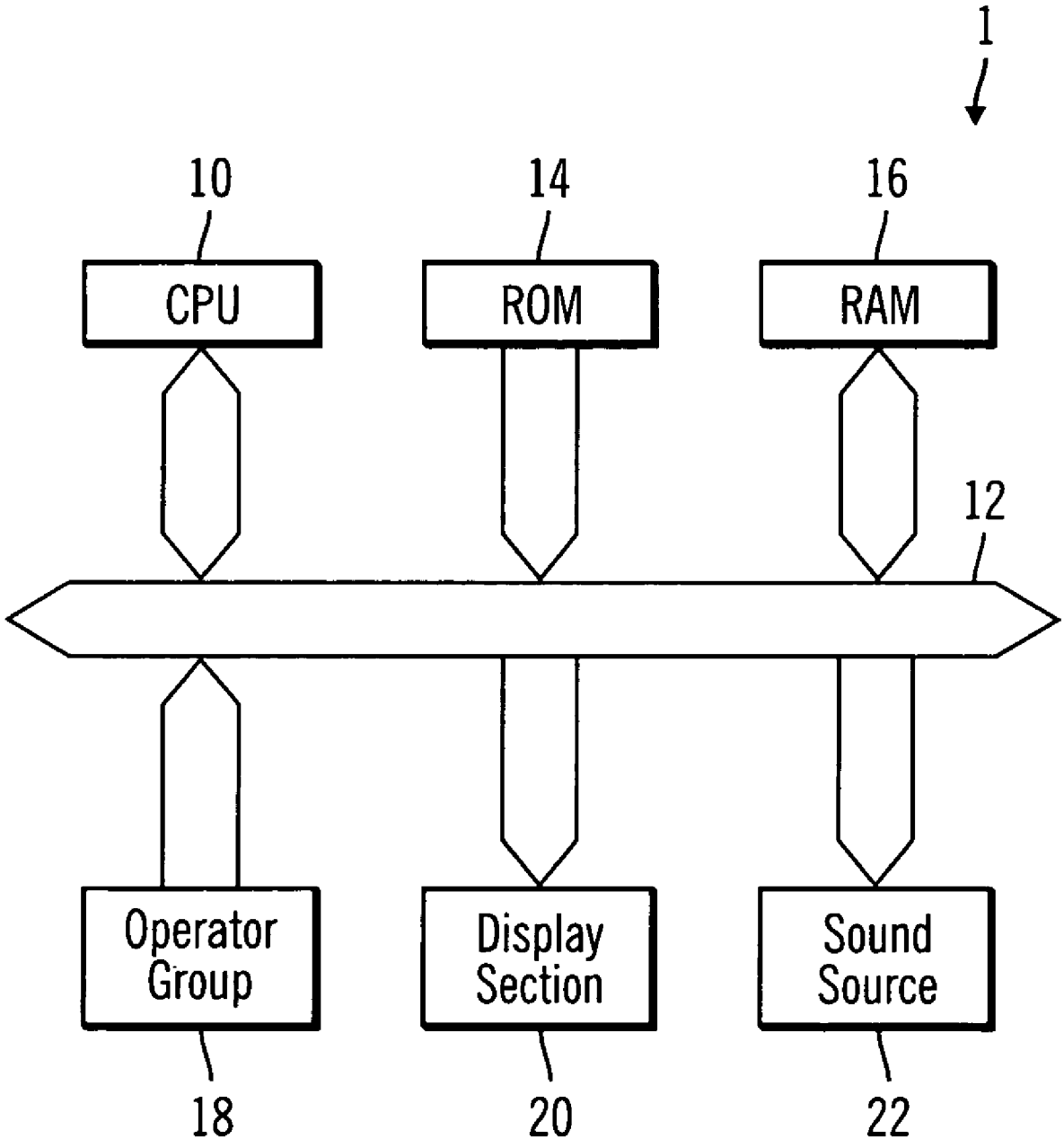
FIG. 1 is a block drawing that shows the electrical configuration of the automatic performance system of the present invention.

An explanation will be given below regarding a desirable preferred embodiment of the present invention while referring to the attached drawings. FIG. 1 is a block drawing that shows hardware components of an automatic performance system 1 in accordance with a first preferred embodiment of the present invention.

The automatic performance system 1 is primarily furnished with the CPU 10 as the central processing unit with which the overall control of the automatic performance system is done, a ROM 14 in which the control program that controls the CPU 10 and the various types of data tables, such as the preset performance pattern table and the like, are stored, a RAM 16 that has a working area in which the various types of registers that are required by the control program that is executed by the CPU 10 and the like are set and an area in which pattern sequence data that have been created by the operator (the performer or the composer) and performance pattern data that have been read out from the ROM 14 are stored, and a temporary area in which data that are being processed are temporarily stored, a group 18 of various types of operators for the operation of the functions and effects of the automatic performance system 1, a liquid crystal display system (the display section) 20 with which the various types of information concerning the performance that is executed by the automatic performance system 1 are displayed, a sound source section 22 with which the musical tones of the performance that is executed by the automatic performance system 1 are produced, and a bus 12 as the path for the connection and exchange of data among each of these various structures.

Figure 2:
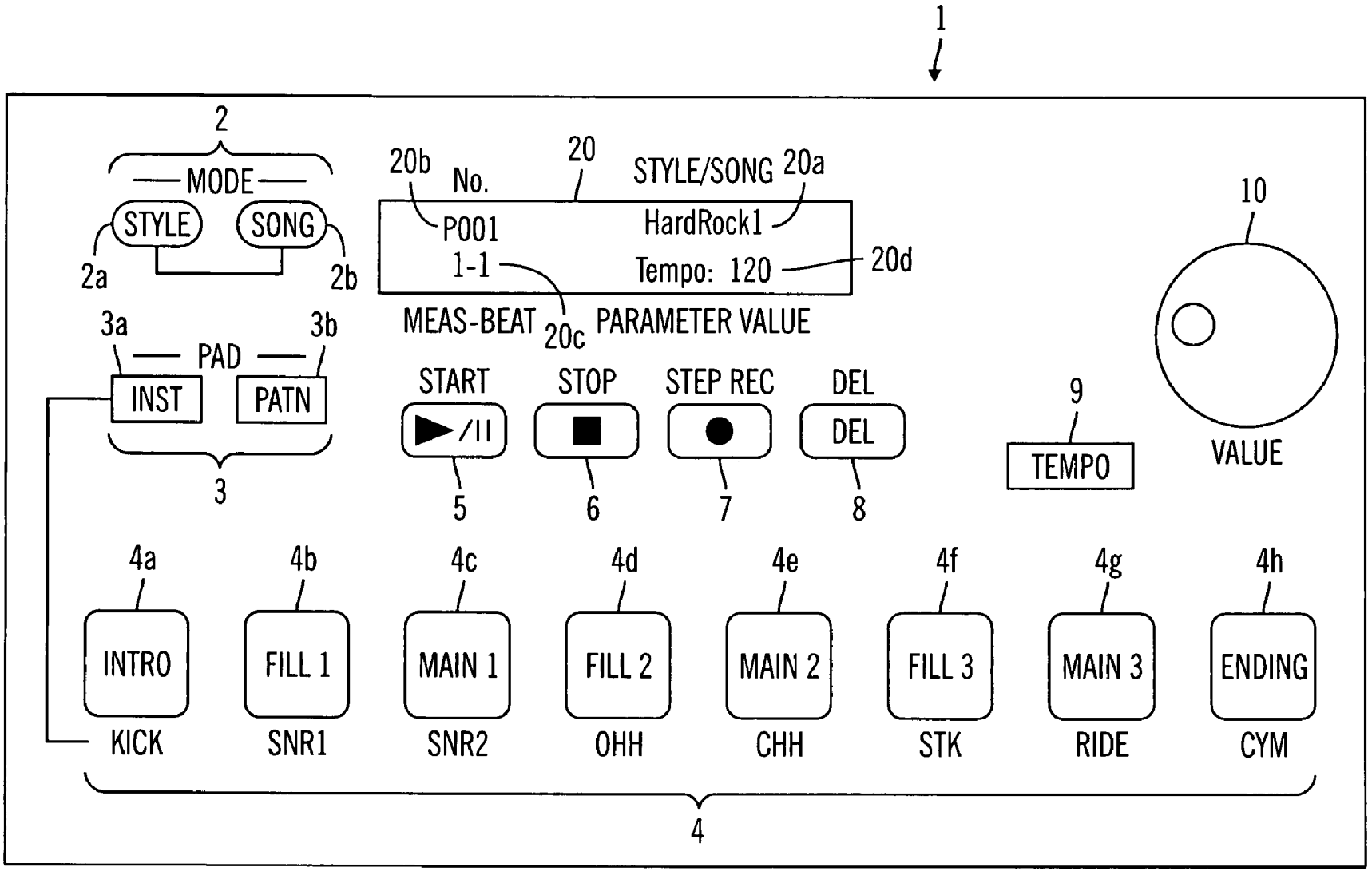
FIG. 2 is a front elevation drawing of the operator panel of the automatic performance system of the present invention.

Next, an explanation will be given regarding the operating panel portion on which the operator group 18 is disposed while referring to FIG. 2. FIG. 2 is a drawing that shows the operator panel of the automatic performance system 1 of the present invention.

The automatic performance system 1 includes a liquid crystal display section 20 that is formed in a roughly rectangular box shape viewed from the front and that displays various types of information concerning the automatic performance system, an automatic performance mode switch 2 for selecting the modes of the automatic performance, a pad mode switch 3 for selecting the modes of the pad, the eight pad (PAD) switches 4 for selecting performance patterns or musical tones, a start/pause (START) switch 5 for starting or pausing the automatic performance, a stop (STOP) switch 6 for stopping the automatic performance, a step recording (STEP REC) switch 7 for switching to the step recording mode, a delete (DEL) switch 8 that instructs the cancellation of the events (the musical tones, volume and the like) that are contained in performance patterns, a tempo (TEMPO) switch 9 for instructing the changes in the tempo of the song, and a rotary encoder 10 for adjusting each of the various parameters for the execution of the automatic performance. Although it is not included in the operator panel of FIG. 2, a pedal switch that is operated with the foot and the like may be included in the operator group. In addition, in the operator panel that is shown in FIG. 2, button switches or rotary encoders are used, but there is no particular restriction to their form and any form switch desired may be used. For example, the button switches 2 to 9 may also be in the form of knobbed switches and the like. Incidentally, with regard to the operator panel section that has been shown in FIG. 2, it is not limited to the example shown of an arrangement of the operator group and the display section 20 and the arrangement can be changed as required.

The automatic performance mode switch 2 comprises a style mode (STYLE) switch 2*a* and a song mode (SONG) switch 2*b*. By pressing either one or the other of the switches, it is possible to set the mode of the automatic performance to either the style mode or the song mode.

In the automatic performance using the style mode, the performer selects a style (jazz, rock, pop and the like), and the performance is started from an intro pattern from among the performance patterns (intro pattern, main pattern and the like) that is defined for the selected style. For each style, one type of intro pattern, three types of main pattern, three types of fill pattern, and one type of end pattern are defined and assigned to a respective one of the PAD switches 4.

On the other hand, in the automatic performance using the style mode, a pattern sequence that has been selected by the performer is performed automatically. The pattern sequence is a sequence of performance patterns. As discussed later, the pattern sequence is created by the operation of the step recording switch 7 and stored as pattern sequence data in the RAM 16 (refer to FIG. 3(*a*)). The further details that are presented herein relate to performance in song mode as opposed to style mode.

The pad mode switch 3 comprises the instrument mode (INST) switch 3*a* with which an event that instructs the production of a musical tone is generated and the pattern mode (PATN) switch 3*b* with which an event that instructs a pattern performance is generated. Because of this, by pressing either one of the INST switch 3*a* or the PATN switch 3*b*, the mode of the PAD switch 4 can be switched. In those cases where the INST switch 3*a* has been pressed, the kick drum (KICK) 4*a*, the snare 1 (SNR 1) 4*b*, the snare 2 (SNR 2) 4*c*, the open high hat (OHH) 4*d*, the closed high hat (CHH) 4*e*, the stick sound (STK) 4*f*, the ride cymbal (RIDE) 4*g*, and the crash cymbal (SYM) 4*h* are respectively assigned to the eight PAD switches 4. On the other hand, in those cases where the PATN switch 3*b* has been pressed, the intro pattern (INTRO) 4*a*, the fill pattern 1 (FILL 1) 4*b*, the main pattern 1 (MAIN 1) 4*c*, the fill pattern 2 (FILL 2) 4*d*, the main pattern 2 (MAIN 2) 4*e*, the fill pattern 3 (FILL 3) 4*f*, the main pattern 3 (MAIN 3) 4*g*, and the ending pattern (ENDING) 4*h* that have been set in advance for each style are assigned to the eight PAD switches 4 in conformance with the currently selected style.

The start (START) switch 5 is a switch with which the performance in the mode that has been selected by the automatic performance mode switch 2 is started. In those cases where the song mode switch 2*b* is pressed, the performance of the pattern sequence that has been selected by the performer is started. When the start switch 5 also doubles as the pause button and the start switch 5 is pressed once more during the performance, the performance is paused. After this, when the start switch is pressed again, the pause is canceled and the performance is started again. In addition, the stop (STOP) switch 6 is a switch for instructing the stopping of the performance.

The step recording switch 7 is a switch that is pressed to produce a pattern sequence by means of step recording. Here, a explanation will be given regarding the pattern sequence creation method using step recording. In the song mode (the song mode switch 2*b* pressed) and the pattern mode (the pattern mode switch 3*b* pressed) state, the step recording switch 7 is pressed. Next, the PAD switch 4 or the rotary encoder 10 is operated and a pattern sequence is produced by the selection of performance patterns in a desired order. For example, the pattern sequence data of FIG. 6(*a*) are produced by the selection of performance patterns in the following order: pattern number (PTN) 2-1 three times, PTN 2-2, PTN 3-1 twice, then PTN 3-2, and so on.

By pressing the delete (DEL) switch 8 during the performance of a pattern sequence that has been created, an event is generated that instructs the deletion of the performance data that corresponds to the PAD switch 4 (4*a* to 4*h*) that is pressed at the same time. When the delete switch 8 and a PAD switch 4*a* to 4*h* are pressed at the same time, only the musical tone that is assigned to the PAD switch 4*a* through 4*h* is deleted from the data. For example, in those cases where the delete switch 8 and the open high hat 4*d* have been pressed at the same time, the open high hat sound is deleted from the data during the time that they are pressed. On the other hand, in those cases where only the delete switch 8 is pressed independently during the performance of the song, none of the data are deleted.

The tempo (TEMPO) switch 9 is pressed to change the tempo of the musical composition during the song or the style performance. When the tempo switch 9 is pressed, the tempo value is displayed on the display section 20, and it is possible to change the tempo value by turning the rotary encoder 10.

The rotary encoder 10 is operated to change parameter values. As discussed above, the tempo can be changed in those cases where the tempo switch 9 has been pressed. The rotary encoder 10 may also be used to select a performance pattern at the time of pattern sequence creation and also to select a pattern sequence to be performed.

The liquid crystal display section 20 displays various types of information related to the song or the style. The song or style name 20*a*, the pattern number 20*b* of the performance pattern, the information 20*c* related to the number of bars and the beat count of the pattern sequence that is being performed, and various types of parameters (for example, the tempo value) 20*d* are displayed on the display section 20.

Figures 3A, 3B:
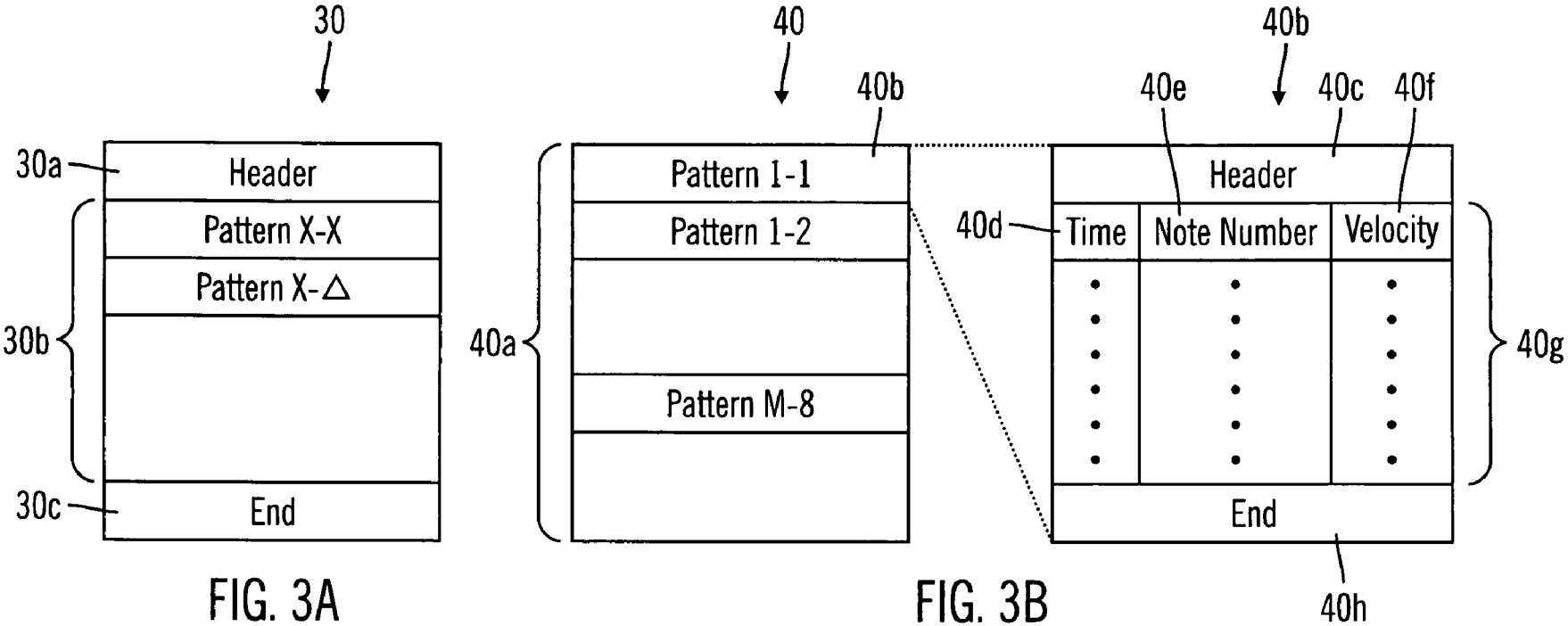
FIG. 3(*a*) is a drawing that schematically shows the configuration of one set of pattern sequence data and FIG. 3(*b*) is a drawing that schematically shows the performance pattern data memory and the configuration of one set of performance pattern data.

FIG. 3 is a drawing that schematically shows the configuration of pattern sequence data and performance pattern data that are stored in the automatic performance system 1. FIG. 3(*a*) is a schematic drawing of pattern sequence data 30 that is stored in the RAM 16 and FIG. 3(*b*) is a schematic drawing of a set of performance pattern data 40 for a style that are read out from the ROM 14 and stored in the RAM 16 and one set of performance pattern data 40*b* that are comprised by the performance pattern data 40.

As is shown in FIG. 3(*a*), the pattern sequence data 30 includes a header 30*a*, which is a block that stores the title of the song, the tempo and the like, a block group 30*b*, in which the order of performance patterns in the performance sequence is represented by the stored order of respective performance pattern identifiers, and the end 30*c*, in which the end data that instruct the ending of the pattern sequence are stored.

As is shown in FIG. 3(*b*), the set of performance patterns 40 for a style is comprised of a plurality 40*a* of individual performance patterns. Each individual performance pattern (for example, PTN 1-1 (40*b*)) comprises a header 40*c* in which the pattern name (the pattern number and identifier) is stored, a block group 40*g* comprised of an ordered set of event information such as a note number 40*e*, a velocity 40*f* and the like, and a time 40*d* for the generation of that event, and an end 40*h*, in which the end data that instruct the ending of the performance pattern are stored. The intro, ending, main 1 to 3, and fill 1 to 3, for a total of eight performance patterns for each of the individual styles 1 through M are stored in the set 40 of performance pattern data. Incidentally, performance patterns that have the new pattern numbers (identifiers) that are created in accordance with this preferred embodiment and the performance patterns that have been created as desired by the operator can additionally be stored in the set 40 of performance pattern data.

Figure 4:
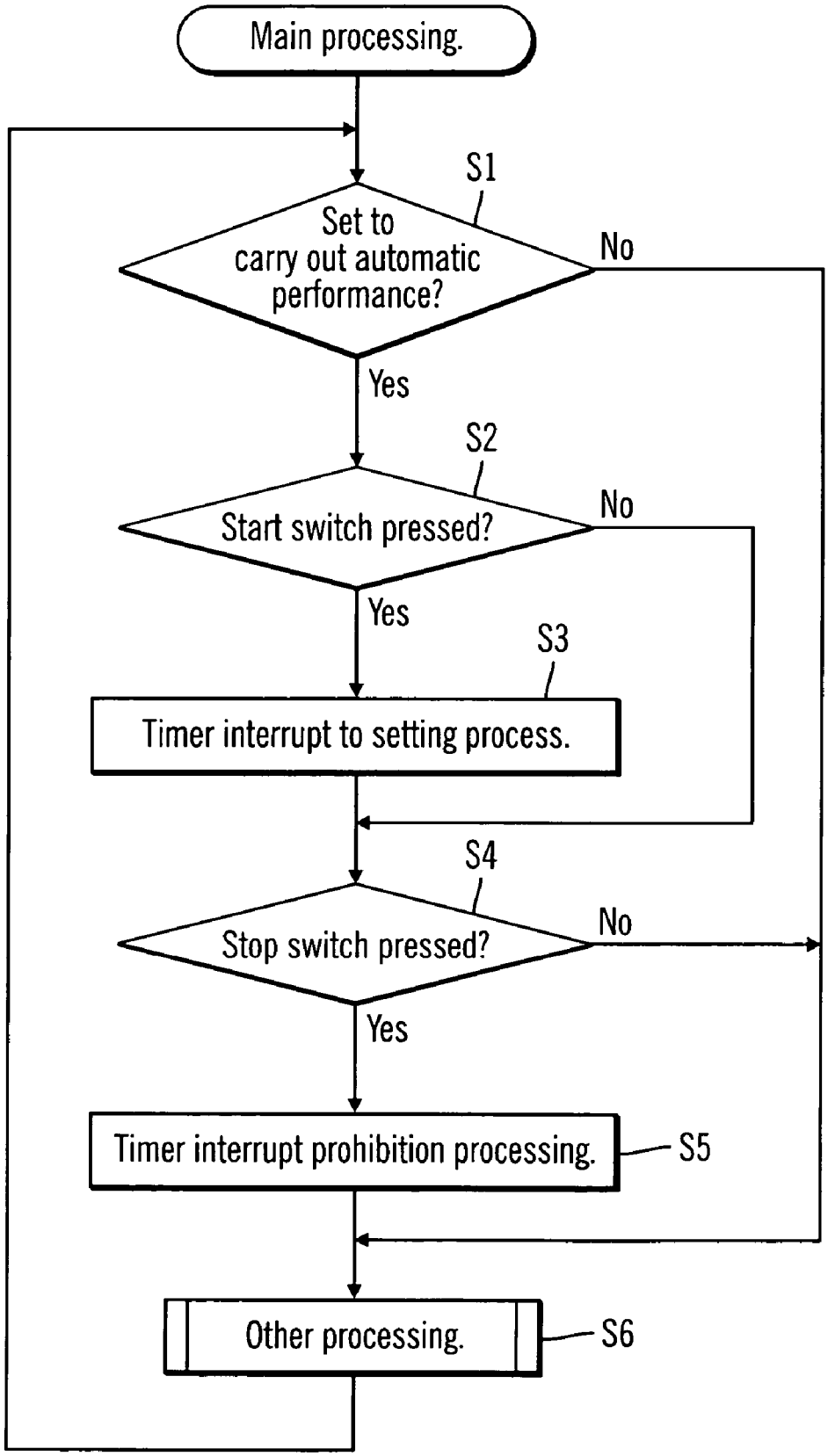
FIG. 4 is a flowchart that shows the main processing that is executed by the CPU.

Next, an explanation will be given regarding the processing that is executed in the first preferred embodiment of the automatic performance system 1 that has been configured as described above while referring to the flowcharts of FIGS. 4 and 5 and to FIG. 6. FIG. 4 is a flowchart of the main processing that is executed by the automatic performance system and this is repeatedly executed by the CPU during the time that the power is on.

First, whether or not the automatic performance system is set to carry out an automatic performance is ascertained (S1). Here, set to carry out an automatic performance means that the automatic performance mode switch 2, in other words, either the style mode switch 2*a* or the song mode switch 2*b*, is in a pressed state.

If the result that has been ascertained by the S1 processing is that the automatic performance system is set to carry out an automatic performance (S1: yes), then next, a determination is made as to whether or not the start switch 5 has been pressed (S2). If the result that has been ascertained by the S2 processing is that the start switch has been pressed (S2: yes), then the setting of the timer interrupt is carried out (S3). By means of the S3 processing, the timing interrupt processing for carrying out such processing as the reading out of the performance patterns and the output to the sound source and the like is done and the tempo value (the number of quarter notes per minute) that is set is interrupted (the timer interrupt) at the time interval (the tick) that has been divided at a specified value (for example, 120).

When, in the timer interrupt processing, it is ascertained by the S4 processing that the stop switch 6 has been pressed (S4: yes), the interrupt is prohibited by the timer interrupt prohibition processing (S5). Next, after the other processing including the setting of the tempo value and the setting of the song or the style and the like has been carried out (S6), the routine returns to S1 and the main processing is repeated.

On the other hand, in those cases where the result that has been ascertained by the S2 processing is that the start switch 5 is not pressed (S2: no), (1) the automatic performance is not started or (2) since the system is in a state in which although it is in the midst of an automatic performance, the timer interrupt setting processing (S3) discussed above is being carried out, the S3 processing is skipped and the routine moves to the S4 processing.

In addition, in those cases where the result that has been ascertained by the S4 processing is that the stop switch 6 has not been pressed (S4:NO), since either (1) the system is in the midst of automatic performance or (2) the start switch 5 has not been pressed and the system is in a performance standby, the S5 processing is skipped, the routine moves to the S6 processing, returns to S1 after that and the main processing is repeated.

Furthermore, in those cases where the result that has been ascertained by the S1 processing is that the system has not been set to carry out an automatic performance (S1: no), the routine moves to the S6 processing, returns to S1 after that and the main processing is repeated.

Figure 5:
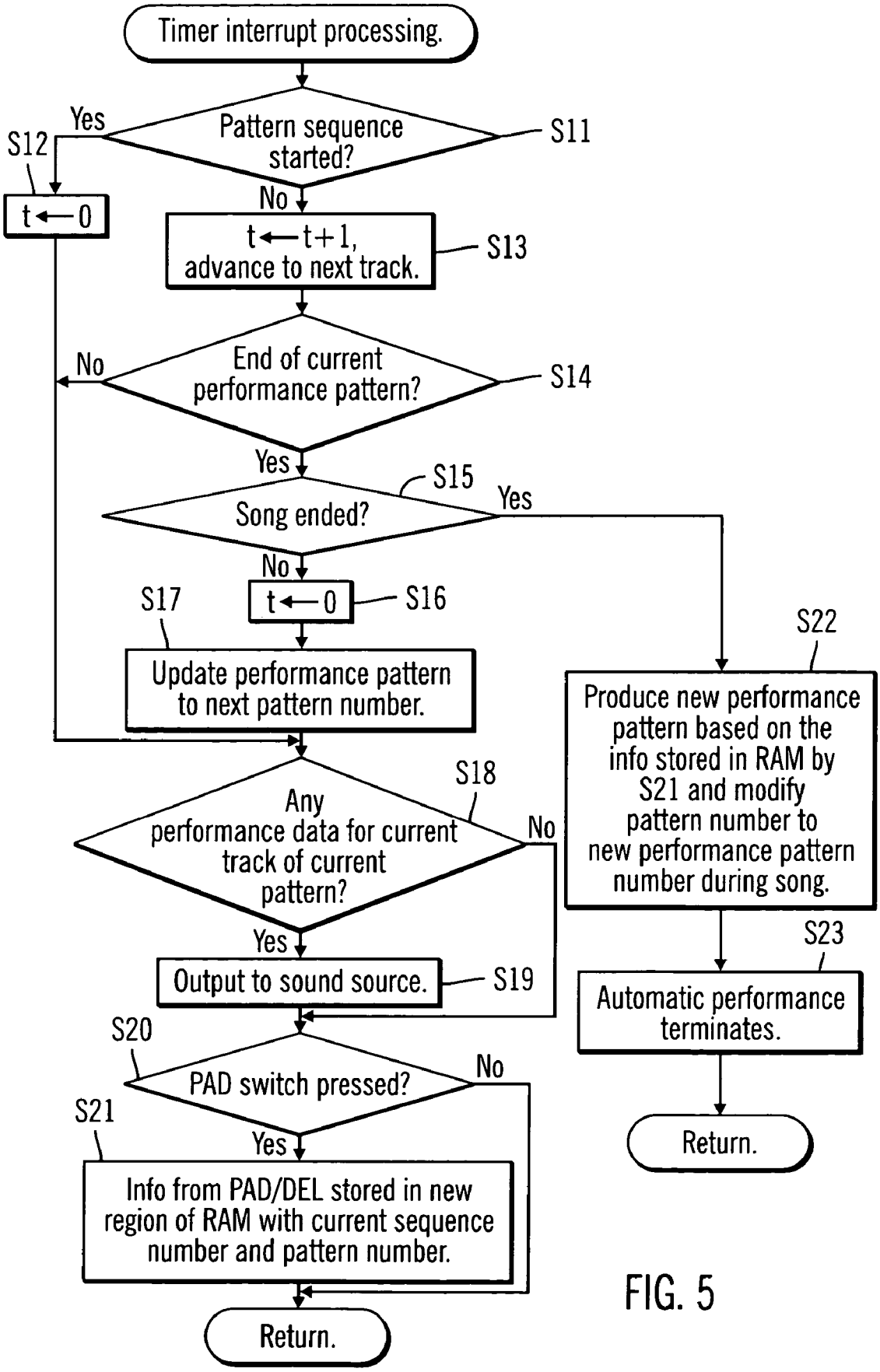
FIG. 5 is a flowchart that shows the timer interrupt processing of a first preferred embodiment of the automatic performance system of the present invention.

Next, an explanation will be given regarding the editing processing of the pattern sequence that is executed in this preferred embodiment while referring to FIG. 5. FIG. 5 is a flowchart of the routine that is launched by the timer interrupt processing when the start switch 5 is pressed in a state in which the song mode has been selected by the automatic performance mode switch 2 and, moreover, the instrument mode has been selected by the pad mode switch 3. In this processing, at the same time as the automatic performance based on the pattern sequence is carried out, a performance event can be added by the operation of a PAD switch 4 (4*a* to 4*h*) and, in addition, it is possible to delete performance data by the operation of the DEL switch 8 and a PAD switch 4.

In the timer interrupt processing, first, whether or not the pattern sequence has been started, in other words, whether or not the first performance pattern in the pattern sequence has been started is ascertained (S11). If the result that has been ascertained by the processing of S11 is that the pattern sequence has been started (S11: yes), the tick value is made "0" (S12) and whether or not there are performance data for the current tick (in this case t=0) of the current performance pattern (in this case, in other words, the first performance pattern) is ascertained (S18).

On the other hand, in those cases where the result that has been ascertained by the S11 processing is that the pattern sequence has not been started (S11: no), "1" is added to the tick value (t) the readout advances to the next tick (S13) and, after the processing of S13, whether or not the tick that has been advanced to next is the end of the current performance pattern is ascertained (S14). If the next tick is not the end of the performance pattern (S14: no), the routine moves to the processing of S18.

In addition, if the result that has been ascertained by the S14 processing is that it is the end of the current performance pattern, then whether or not it is the end of the pattern sequence is ascertained next (S15). If the result that is ascertained by the S15 processing is that it is not the end of the pattern sequence (S15: no), the tick value is made "0" (S16), the performance pattern is updated to the next pattern number (S17), and the routine moves to the processing of S18.

Next, if the result that is ascertained in the S18 processing as to whether or not there are performance data for the current tick of the current performance pattern is that there are performance data (S18: yes), those data are output to the sound source section 22 (S19). If data are output to the sound source by the S19 processing, next, whether any of the PAD switches 4 (4*a* to 4*h*) has been pressed is ascertained (S20). On the other hand, if the result that has been ascertained by the S18 processing is that there are no performance data (S18: no), in other words, a case in which no musical tone data exist that should be output to the sound source section 22, the processing of S19 is skipped and the routine moves to the S20 processing.

In those cases where in the S20 processing, it has been ascertained that any of the PAD switches 4 has been pressed (S20: yes), information including the time, the type of PAD switch 4 that has been pressed and the pressing strength, as well as whether or not the DEL switch 8 has been pressed at the same time, and identifier of the current performance pattern and its location within the pattern sequence, are stored in a new area of the RAM 16 (S21). After the processing of S21, the timer interrupt processing finishes and the routine returns. In addition, if the result that has been ascertained in the S20 processing is that a PAD switch 4 has not been pressed (S20: no), the timer interrupt ends as it is and returns.

On the other hand, if the result that has been ascertained by the S15 processing is that it is the end of the pattern sequence (S15: yes), a new performance pattern is produced based on the information that has been stored in the RAM 16 by the S21 processing (S22). In the case where in S22, the performance pattern that corresponds to the pattern number of the performance pattern that has been stored in the RAM 16 by the processing of S21 is read out and a PAD switch 4 (4*a* to 4*h*) has been pressed but the DEL switch 8 has not been pressed, event data that correspond to the musical tone that matches that PAD switch, the strength and the time of the tone are inserted into the performance pattern to produce a new performance pattern. On the other hand, in those cases where both a PAD switch 4 and the DEL switch 8 have been pressed at the same time, the event data that correspond to the note and time of the pressed PAD switch (4*a* to 4*h*) are deleted from the performance pattern to produce a new performance pattern. A new pattern identifier is associated with to the new performance pattern, and the pattern sequence is updated to substitute the new performance pattern identifier in place of the performance pattern that was changed by the performer's use of the PAD and DEL switches. The S22 processing is carried out for all of the information that has been stored in the RAM 16 by the processing of S21. After the S22 processing, the automatic performance ends (S23), the timer interrupt processing finishes and returns.

Incidentally, with the timer interrupt processing of this preferred embodiment, the S20 to S21 processing is carried out after the S18 to S19 processing but the S18 to S19 processing may also be carried out after the S20 to S21 processing. In other words, even in those cases where a PAD switch 4 and the DEL switch 8 have been pressed at the same time in the S21 processing, a musical tone is generated due to the S19 processing which occurred first but it may be set up such that in those cases where the S18 to S19 processing is carried out after the S20 to S21 processing and a PAD switch 4 (4*a* to 4*h*) and the DEL switch 8 have been pressed at the same time, the musical tone that corresponds to the PAD switch 4 (4*a* to 4*h*) that has been pressed is not generated.

In addition, with the timer interrupt processing of this preferred embodiment, the information concerning the PAD switch 4 or the DEL switch 8 that were pressed in S20 is stored in a new area of the RAM 16 in the S21 processing, and, when the pattern sequence ends, a new performance pattern is produced in the S22 processing from the performance pattern at the time that the information was stored in the RAM 16 by the S21 processing and, together with this, the identifier of the pattern to which it corresponds in the pattern sequence is updated. However, it may also be set up such that this is stored to the RAM 16 together with the time data (timing data) during the performance based on the sequence pattern without differentiating the event that is produced based on the sequence pattern and the event that is produced by the operator, new identifiers are set for the performance patterns of the locations for which the operator has been operated, and the new identifiers rewritten for the locations in the pattern sequence. In this case, the operator is operated and the new identifier is maintained for the performance pattern that has been set, and the performance pattern in which the operator has not been operated is handled as an empty region.

Figure 6A:
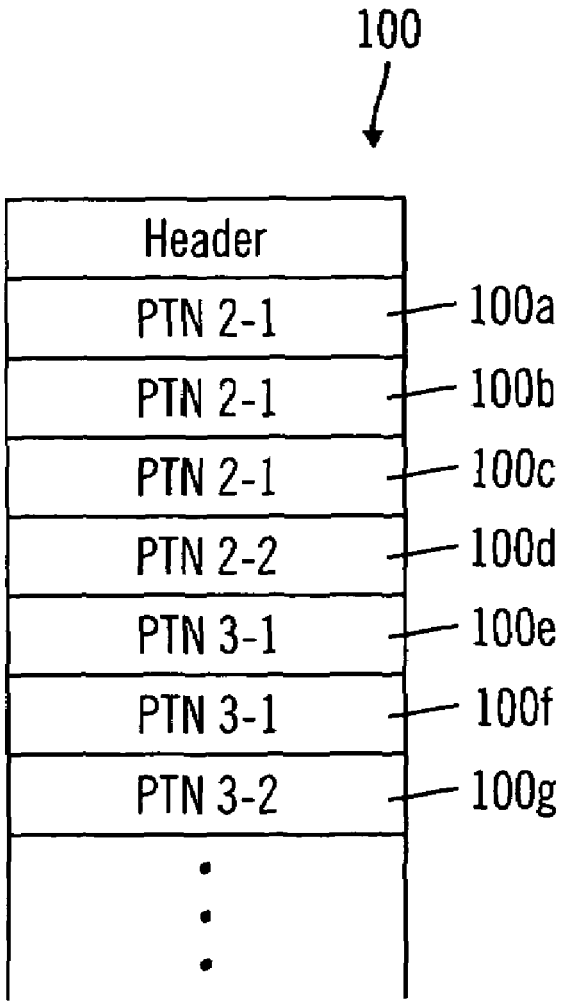
FIG. 6(*a*) and FIG. 6(*b*) are drawings that schematically show the changes in the pattern sequence data in accordance with the first preferred embodiment of the automatic performance system of the present invention.
Figure 6B:
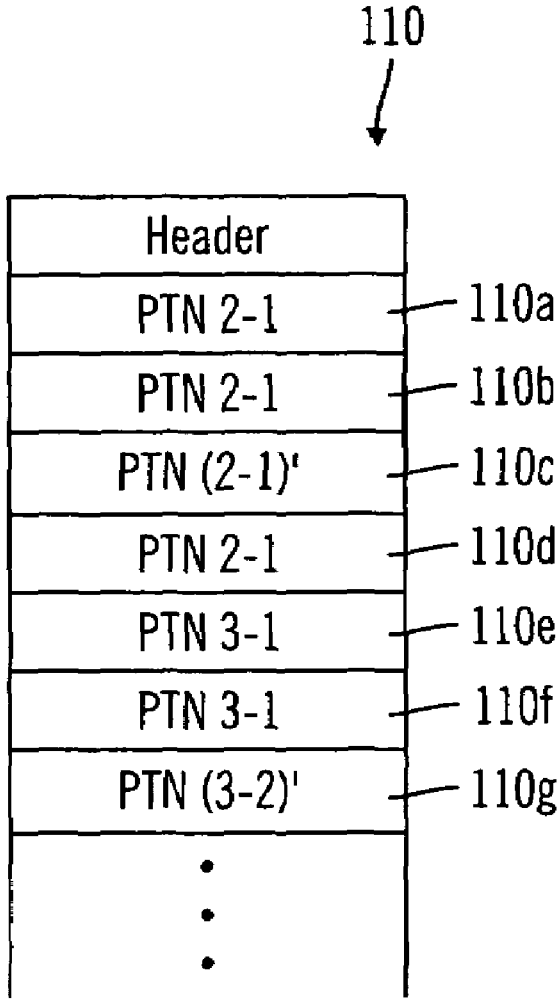

FIG. 6 is a drawing that schematically shows the changes in the pattern sequence data in accordance with the first preferred embodiment of the automatic performance system 1 of the present invention. FIG. 6(*a*) shows the pattern sequence data 100 before the change, and FIG. 6(*b*) shows the pattern sequence data 110 after a partial change has been effected by an operation during the pattern sequence performance. An explanation will be given regarding this preferred embodiment while referring to FIG. 6. In the automatic performance system 1 in which a performance is carried out in accordance with a pattern sequence, when the PAD switch 4 and, as required, the DEL switch 8 are operated at the desired location during the performance of PTN 2-1 (100*c*), corresponding portions of the performance pattern are changed by the processing of S21 and S22 discussed above, and the original performance pattern identifier PTN 2-1 (100*c*) in the pattern sequence is updated to the new performance pattern identifier PTN (2-1)' (110*c*). In the same manner, when the PAD switch 4 and, as required, the DEL switch 8 are operated during-the performance of PTN 3-2 (100*g*), PTN 3-2 (100*g*) is updated in the pattern sequence to a new performance pattern having the identifier PTN (3-2)' (110*g*). As a result, a new pattern sequence 110 comprised of new performance patterns is obtained.

With the automatic performance system 1 of the present invention, as has been explained above, it is possible for the operator (the performer or the composer) to edit the performance patterns of a pattern sequence by pressing the PAD switch 4 and, as required, the DEL switch 8 during a performance of the pattern sequence.

Next, an explanation will be given regarding the action of a second preferred embodiment of the automatic performance system 1 of the present invention while referring to the flowcharts of FIG. 7 and FIG. 8. With the first preferred embodiment, when an operation is carried out to change the pattern during a pattern sequence performance, only that operation information is stored and the pattern for which there was an operation is changed after the completion of the pattern sequence performance and new pattern sequence data are produced. In contrast, in the second preferred embodiment, the performance pattern is changed for each operation that is carried out during the pattern sequence performance. Incidentally, the same codes are appended for the portions that are identical to those in the preferred embodiment 1 and their explanation has been omitted.

Figure 7:
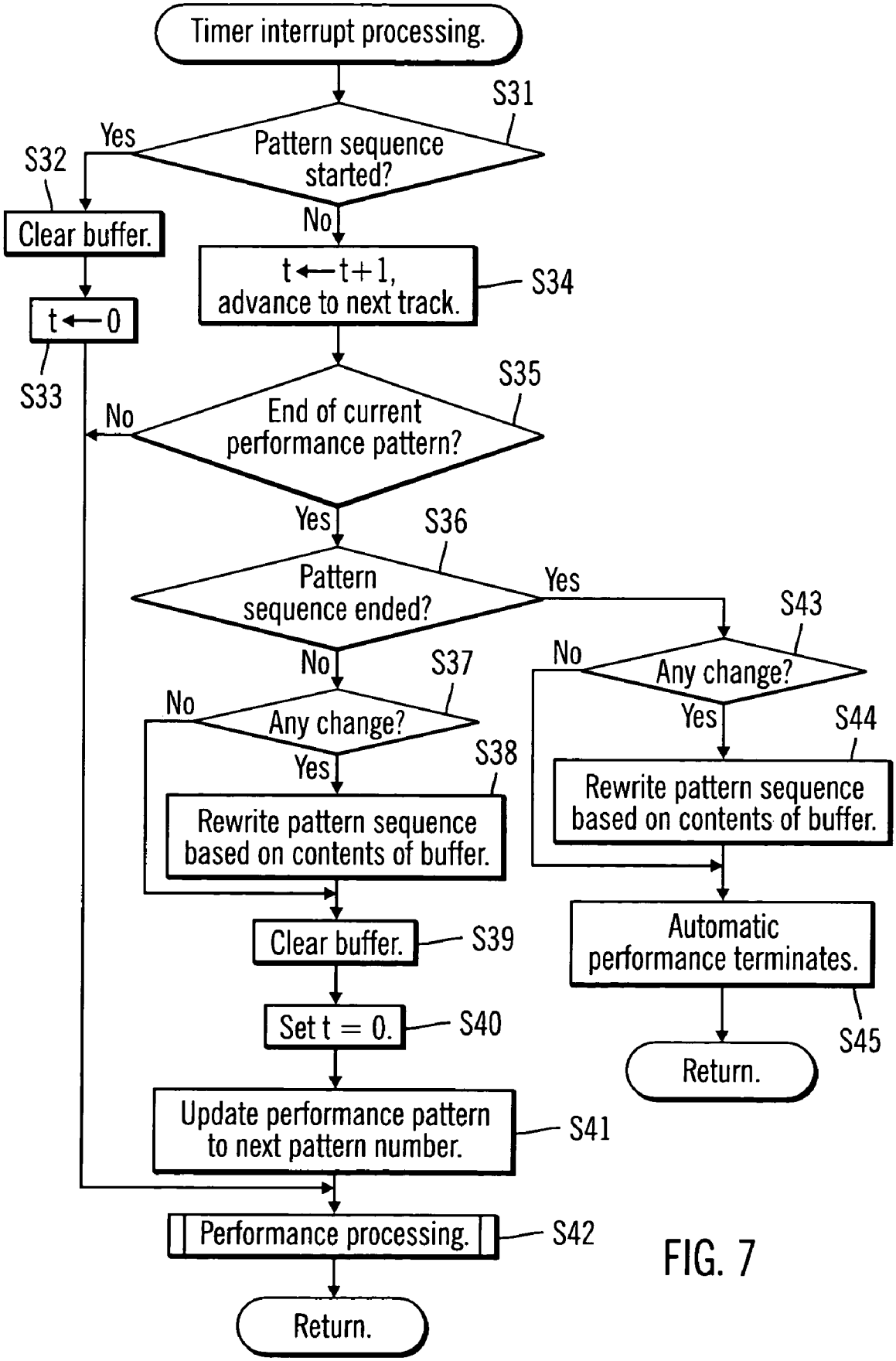
FIG. 7 is a flowchart that shows the timer interrupt processing in accordance with a second preferred embodiment of the automatic performance system of the present invention.
Figure 8:
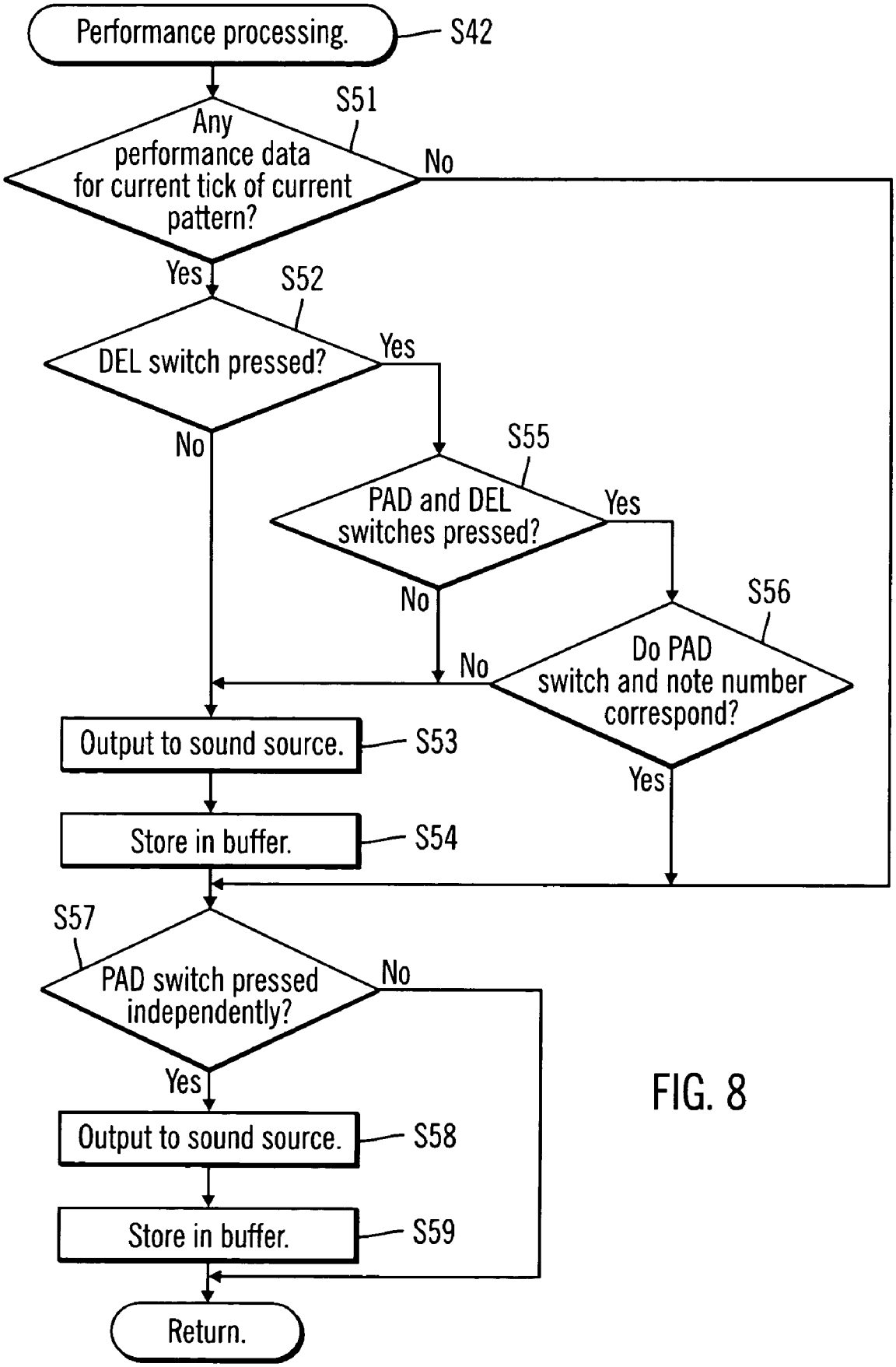
FIG. 8 is a flowchart that shows the performance processing in the second preferred embodiment of the present invention.

FIG. 7 is a flowchart of the timer interrupt processing for carrying out the pattern sequence editing processing that is executed by the second preferred embodiment. With the timer interrupt processing of the second preferred embodiment, in the same manner as in the case of the first preferred embodiment, when the start switch 5 is pressed in a state in which the song mode is selected by the automatic performance mode switch 2 and, moreover, the instrument mode is selected by the pad mode switch 3, the routine is launched for each tick in conformance with the tempo that is set.

When the timer interrupt processing is launched, first, whether or not the pattern sequence has been started, in other words, whether or not the first performance pattern in the pattern sequence has been started, is ascertained (S31). If the result that has been ascertained by the processing of S31 is that the pattern sequence has been started (S31: yes), the buffer that has been furnished in the RAM 16, which is not shown in the drawing, is cleared (S32), the tick value is made "0" (S33), and the routine moves to the performance processing (S42) that will be discussed later.

Here, an explanation will be given regarding the performance processing (S42) while referring to the flowchart of FIG. 8. The performance processing (S42) is processing for outputting the current performance data in accordance with the pattern number of the performance pattern and the tick value during the current performance to the sound source and, executes the deletion of an event or inserts an event in the current performance data based on the change in the case in which there has been a change in the current performance data due to the operation of a specified operator.

In the performance processing (S42), whether or not there are performance data for the current tick in the current performance pattern number is ascertained (S51). If the result that is ascertained by the S51 processing is that performance data exist for the current tick in the current performance pattern number (S51: yes), whether or not the DEL switch 8 has been pressed is ascertained (S52). If the result that has been ascertained by the S52 processing is that the DEL switch has not been pressed (S52: no), the performance data for the current tick in the current performance pattern number (the current performance data) are output to the sound source section 22 (S53). After the processing of S53, the current performance data that have been output by the sound production instruction to the sound source section 22 in the S53 processing (the performance data for which the sound production instruction was made to the sound source section 22) are stored in the buffer together with the value of the current tick (S54). After the S54 processing, the routine moves to the processing of S57 which will be discussed later.

On the other hand, if the result that has been ascertained by the S52 processing is a case in which the DEL switch 8 has been pressed (S52: yes), whether or not a PAD switch 4 has been pressed together with the DEL switch 8 is ascertained (S55). If the result that has been ascertained by the S55 processing is that a PAD switch 4 has not been pressed (S55: no), since a musical tone that should be deleted (event) has not been selected, the current performance data are output to the sound source section 22 (S53) and the routine moves to the processing of S54.

On the other hand, if the result that has been ascertained by the S56 processing is that a PAD switch 4 has been pressed together with the DEL switch 8 (S55: yes), whether or not the PAD switch 4 (4*a* to 4*h*) that has been pressed and the current performance data correspond is ascertained (S56). If the result that has been ascertained by the S56 processing is that the PAD switch 4 that has been pressed and the current performance data do not correspond (S56: no), since performance data do not exist in the current performance data for which an instruction that they should be deleted has been made by the PAD switch 4, the current performance data are output to the sound source 22 (S53) and the routine moves to the processing of S54.

On the other hand, if the result that has been ascertained by the S56 processing is a case in which the PAD switch 4 that has been pressed and the current performance data correspond (S56: yes), the processing of S53 to S54 is skipped and the routine moves to the processing of S57 that will be discussed later. In other words, the performance data that are included in the current performance data and for which an instruction to delete has been made using the DEL switch 8 and the PAD switches 4 are not output to the sound source 22 nor are they stored in the buffer. Therefore, sounds are not produced for the performance data which it has been ascertained by the S56 processing are to be deleted and, in addition, by means of the processing of S38 or S44, the data that are instructed to be deleted for the time that corresponds to the timing that is instructed to be deleted are deleted and are rewritten as a new song.

On the other hand, in those cases where the result that has been ascertained by the S51 processing is that performance data do not exist for the current tick of the current performance pattern (S51: no), since no musical tone data exist that should be produced for the current tick of the current performance pattern, the processing of S52 to S56 is skipped and the routine moves to the processing of S57.

In the S57 processing, whether or not a PAD switch 4 (4*a* to 4*h*) has been pressed independently, in other words, whether or not a PAD switch 4 has been pressed without pressing the DEL switch 8 is ascertained (S57). If the result that has been ascertained by the S57 processing is that a PAD switch 4 has been pressed independently (S57: yes), an event is formed for the performance data of the musical tone and strength that correspond to the PAD switch 4 (4*a* to 4*h*) that has been pressed and the performance data are output to the sound source section 22 (S58). After the S58 processing, the performance data for which a sound production instruction has been made to the sound source 22 in the S58 processing are stored in the buffer together with the value of the current tick (S59). After the S59 processing, this performance processing (S42) ends.

By means of the processing of S58 to S59, the performance data that correspond to the PAD switch 4 that has been operated independently during the pattern sequence performance are emitted together with the performance data that have been output to the sound source section 22 by the S53 processing, in other words, the musical tones that correspond to the performance data for the current tick of the current performance pattern (the current performance data). Or in those cases where performance data that are output to the sound source section 22 do not exist, in other words, in those cases where the processing of S53 has not been carried out, sound is emitted only for a musical tone in accordance with the event for the performance data that has been formed based on the operation of the PAD switch 4 that was ascertained by the S57 processing. In addition, the event for the performance data that has been newly formed by the processing of S58 is inserted at the time that corresponds to the timing for which the insertion of the musical tone has been instructed by the processing of S38 or S44 that will be discussed later and rewritten as a new song.

On the other hand, if the result that was ascertained by the S57 processing is that a PAD switch 4 has not been pressed independently (S57: no), since a musical tone that is inserted as performance data for the current tick of the current performance data has not been formed, the processing of S58 to S59 is skipped and this performance processing (S42) ends.

The explanation will be given returning to FIG. 7. After the execution of the performance processing (S42), the timing interrupt processing terminates and returns.

On the other hand, in those cases where the result that has been ascertained in the S31 processing is that a pattern sequence has not started (S31: no), "1" is added to the tick value (t) and the readout advances to the next tick (S34). After the processing of S34, whether or not the tick that has been advanced to next is the end of the current performance pattern is ascertained (S35). If the next tick is not the end of the performance pattern (S35: no), the routine moves to the processing of the performance processing discussed above (S42).

In addition, if the result that has been ascertained by the S35 processing is that it is the end of the current performance pattern (S35: yes), then whether or not it is the end of the pattern sequence is ascertained next (S36). If the result that is ascertained by the S36 processing is that it is not the end of the pattern sequence (S36: no), whether or not there has been a change in the performance processing (S42) to the performance data for the current tick of the current performance data is ascertained (S37).

Here, "there is a change to the performance data" indicates the following two cases in the performance processing (S42): (1) a case in which the processing of S53 to S54 is skipped based on the fact that the DEL switch 8 has been operated together with a PAD switch 4 during the pattern sequence performance, in other words, a case in which the event for the current tick of the current performance data is deleted, and (2) a case in which the event for the current tick of the current performance data is inserted based on the fact that a PAD switch 4 has been pressed independently during the pattern sequence performance.

In the case where the result that has been ascertained in the S37 processing is that there are changes in the performance data (S37: yes), the pattern sequence is rewritten based on the contents that have been stored in the buffer in the S54 processing (S38). In the S38 processing, first, the contents that have been stored in the buffer are copied to the region in the RAM 16 that is indicated by the specified address, a new pattern number (identifier) is assigned to the contents that have been copied, and a new performance pattern is produced. Incidentally, the new pattern number is a pattern number that maintains the attribution of the current (the original) pattern number (identifier). Next, the current (the original) pattern number for the pattern sequence is rewritten with a new pattern number.

After the processing of S38, the buffer is cleared (S39), the tick value is made "0" (S40), the performance pattern is updated to the next pattern number (S41), and the routine moves to the performance processing (S42). On the other hand, if the result that has been ascertained by the S37 processing is that there has been no change in the performance data (S37: no), S38 is skipped and the routine moves to the processing of S39.

In addition, in a case where the result that has been ascertained by the S36 processing is that it is the end of the pattern sequence (S36: yes), whether or not there has been a change in the performance data in the performance processing (S42) is ascertained (S43). In a case where the result that has been ascertained by the S43 processing is that there has been a change in the performance data (S43: yes), the pattern sequence is rewritten in essentially the same manner as in the processing of S37 based on the contents that have been stored in the buffer in the S54 processing (S44), the automatic performance terminates automatically (S45) and the timing interrupt processing terminates and returns. On the other hand, if the result that has been ascertained by the S43 processing is that there has been no change in the performance data (S43: no), the processing of S44 is skipped and the routine moves to the S45 processing Incidentally, when it is ascertained whether or not there has been a change in the performance data during the performance in the timer interrupt processing of the second preferred embodiment described above (FIG. 7), the processing of rewriting the pattern sequence based on the contents that have been stored in the buffer in those cases where there has been a change in the performance data is carried out after the end of the pattern sequence has been ascertained by the processing of S36. However, it may also be configured such that this processing (S37 to 38 processing and S43 to S44) is done between S35 and S36.

Figure 9A:
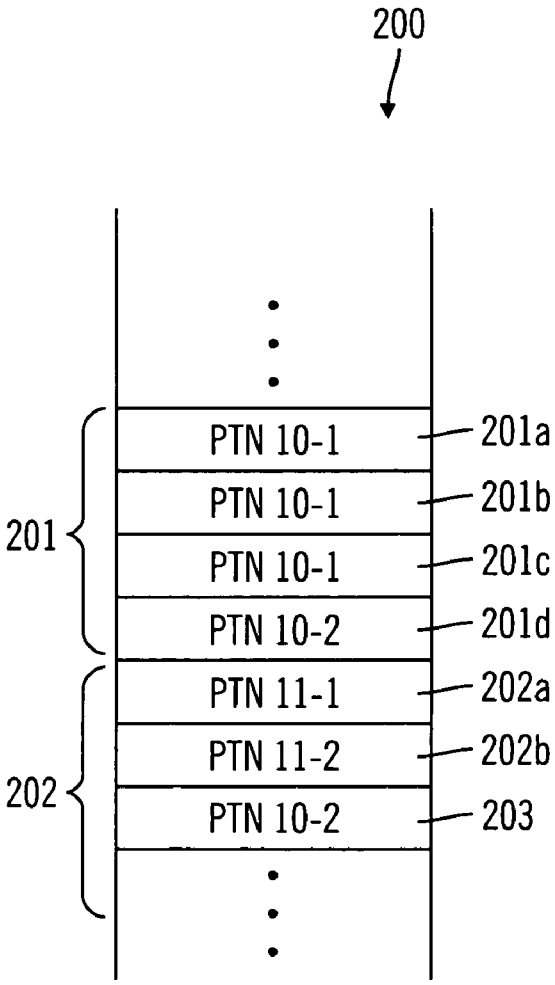
FIG. 9(*a*) and FIG. 9(*b*) are drawings that schematically show the changes in the pattern sequence data in accordance with a third preferred embodiment of the present invention.
Figure 9B:
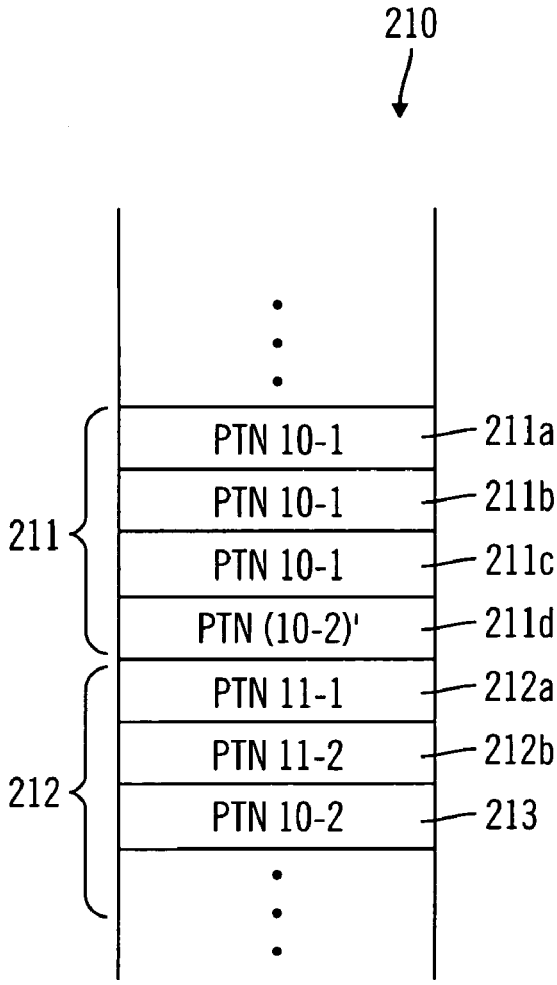

Next, an explanation will be given regarding a third preferred embodiment while referring to FIG. 9. FIG. 9(*a*) shows the pattern sequence data 200 before the change and FIG. 9(*b*) shows the pattern sequence data 210 after a partial change. Incidentally, the same codes are appended for the portions that are identical to those in the preferred embodiment 1 and their explanation has been omitted.

In the first preferred embodiment described above, it was set up such that a sequential performance is carried out in accordance with the performance order of the performance pattern. In contrast to this, in the third preferred embodiment, performance patterns of the same group (style) that are consecutive in the pattern sequence are repeated and performed as one block and when an operation has been made with an operator such as a pedal switch and the like, the shift to the next block is done after the performance to the end of that block.

An explanation will be given referring to FIG. 9(*a*). For example, in the third preferred embodiment, the three PTN (pattern numbers) 10-1 (201*a* to 201*c*) and PTN 10-2 (201*d*) are viewed as the single block 201 and PTN 11-1 (202*a*) and PTN 11-2 (202*b*) as the single block 202. In this case, 201*a* to 201*d* of block 201 are repeated and performed and when a pedal switch (not shown in the drawing) that is contained in the operator group is stepped on, after the performance is done up to PTN 10-2 (201*d*), which is the end of the block 201, the next block 202 is performed. Here, in the same manner as in the first preferred embodiment, when a PAD switch 4 and, as required, the DEL switch 8 are operated, as is shown in FIG. 9(*b*), a new pattern sequence 210 is produced that contains a newly formed performance pattern (PTN (10-2)' (211*d*)). When this new pattern sequence 210 is performed, PTN (pattern number) 10-1 (211*a* to 211*c*) and PTN (10-2)' (211*d*) are viewed as the single block 211 and repeated and performed until an operation of the pedal switch is made. In other words, by means of the automatic performance system 1 of the present invention, since the change is made with the performance pattern maintaining the original group assignment, under conditions such as those of the third preferred embodiment, the performance order is not affected even in those cases where an automatic performance is carried out.

Explanations of the present invention have been provided based on the above preferred embodiments, however, the present invention is not in any way limited to the preferred embodiments described above and it can easily be surmised that various modifications and variations are possible within a range that does not deviate from the tenor of the present invention.

For example, in the first through the third preferred embodiments described above, all were set up as automatic performance systems with which a rhythm performance is carried out but they may also be automatic performance systems that carry out a bass performance or a chord performance.

In addition, in the first through the third preferred embodiments described above, the performance data are edited in the song mode by the operation of an operator but it may also be set up such that a separate switch is provided and the editing is carried out only when editing has been instructed by that switch so as to prevent an operator being inadvertently touched or the like during a performance and the performance data erroneously rewritten.

By means of the automatic performance system of the present invention, it is possible to change a portion of the pattern sequence by the operation of an operator during a performance. This provides the advantageous result of changing a portion of the performance by merely operating an operator during the performance without the need, as in the past, to redo from the beginning the creation of the performance pattern that it is desired to change in order to change a portion of the pattern sequence. In addition, since this kind of partial change of the pattern sequence is carried out while listening to the performance, the present invention also has the advantageous result that a musically suitable change is done easily while the performer perceives the flow of the entire performance.

What is claimed is:

1. An automatic performance system comprising:

performance pattern storage means for storing a plurality of performance patterns, the performance patterns comprising data representing events corresponding to the production of tones;

pattern sequence storage means for storing pattern sequence data representing a sequence of said performance patterns, the pattern sequence data including identifiers of performance patterns in the sequence, the identifiers having a predefined attribute;

signal processing means for producing tones corresponding to the performance patterns of a pattern sequence;

an operator for use by a user during performance of a pattern sequence to generate events representing the addition of a tone to or deletion of a tone from the pattern sequence at the location in the pattern sequence at which the event is generated;

creation means for creating a new performance pattern in accordance with events generated by the operator and a performance pattern that was performed during occurrence of those events; and modification means for modifying the pattern sequence data to substitute in the pattern sequence data, an identifier of the new performance pattern for the identifier of the performance pattern from which it was created with the same attribute as the predefined attribute.

2. The automatic performance system cited in claim 1, wherein the operator generates an event that represents the addition of a musical tone to the performance pattern.

3. The automatic performance system cited in claim 1, wherein the operator generates an event that represents the deletion of a tone from the performance pattern.

4. The automatic performance system cited in claim 1, wherein the new performance pattern created by the creation means adds tones and deletes tones in accordance with events generated by the operator and the timing of the occurrence of those events during performance of the performance pattern from which it is created.

5. The automatic performance system cited in claim 1, wherein the predefined attribute comprises at least one of a performance pattern or a style of the sequence of performance patterns.

6. A programmable device for automatically producing tones, the device including a computer readable medium storing programming code for controlling the device to perform processing comprising:

storing a plurality of performance patterns, the performance patterns comprising automatic performance data representing events corresponding to the production of tones;

storing pattern sequence data representing a sequence of said performance patterns, the pattern sequence data including identifiers of performance patterns in the sequence, the identifiers having a predefined attribute;

performing a pattern sequence by generating tones represented in the performance patterns of the pattern sequence data;

receiving user input during the performance of the pattern sequence;

in accordance with the user input, updating at least one of the performance patterns in the sequence data to add tones to or delete tones in accordance with the user input, to create a new performance pattern; and modifying the pattern sequence data to substitute in the pattern sequence data, an identifier of the new performance pattern for the identifier of the performance pattern from which it was created with the same attribute as the predefined attribute.

7. The device claimed in claim 6, wherein the event generated by user input is an event representing the addition of a tone, and wherein at least one of the performance patterns in the pattern sequence is updated to add the tone represented by the user input at a location during the performance of the pattern sequence at which the user input was received.

8. The device claimed in claim 7, wherein the user input is produced by the operation of an operator representing a particular tone.

9. The device claimed in claim 6, wherein the event generated by user input is an event representing the deletion of a tone, and wherein at least one of the performance patterns in the pattern sequence is updated to add the tone represented by the user input at a location during the performance of the pattern sequence at which the user input was received.

10. The device claimed in claim 9, wherein the user input is produced by the concurrent operation of an operator representing a particular tone and an operator representing the deletion of a tone.

11. The device claimed in claim 6, wherein the tones comprise musical notes.

12. The device claimed in claim 6, wherein the tones comprise percussive sounds.

13. The automatic performance device of claim 6, wherein the predefined attribute comprises at least one of a performance pattern or a style of the sequence of performance patterns.

14. A method in a device for automatically producing tones, comprising:

storing a plurality of performance patterns, the performance patterns comprising automatic performance data representing events corresponding to the production of tones;

storing pattern sequence data representing a sequence of said performance patterns, the pattern sequence data including identifiers of performance patterns in the sequence, the identifiers having a predefined attribute;

performing a pattern sequence by generating tones represented in the performance patterns of the pattern sequence data;

receiving user input during the performance of the pattern sequence;

in accordance wit the user input, updating at least one of the performance patterns in the sequence data to add tones to or delete tones in accordance with the user input to create a new performance pattern; and modifying the pattern sequence data to substitute in the pattern sequence data, an identifier of the new performance pattern for the identifier of the performance pattern from which it was created with the same attribute as the predefined attribute.

15. The method claimed in claim 14, wherein the event generated by user input is an event representing the addition of a tone, and wherein at least one of the performance patterns in the pattern sequence is updated to add the tone represented by the user input at a location during the performance of the pattern sequence at which the user input was received.

16. The method claimed in claim 15, wherein the user input is produced by the operation of an operator representing a particular tone.

17. The method claimed in claim 14, wherein the event generated by user input is an event representing the deletion of a tone, and wherein at least one of the performance patterns in the pattern sequence is updated to add the tone represented by the user input at a location during the performance of the pattern sequence at which the user input was received.

18. The method claimed in claim 17, wherein the user input is produced by the concurrent operation of an operator representing a particular tone and an operator representing the deletion of a tone.

19. The method claimed in claim 14, wherein the tones comprise musical notes.

20. The method claimed in claim 14, wherein the tones comprise percussive sounds.

21. The automatic performance method of claim 14, wherein the predefined attribute comprises at least one of a performance pattern or a style of the sequence of performance patterns.

22. A method in a device for automatically producing tones, comprising:

storing a plurality of performance patterns that include musical data representing events corresponding to the production of tones;

storing pattern sequence data representing a sequence of said performance patterns, the pattern sequence data including identifiers of performance patterns in the sequence, the identifiers having a predefined attribute;

performing a pattern sequence by generating tones corresponding to the performance patterns of a sequence represented in the stored pattern sequence data;

receiving user input during the performance of the pattern sequence;

creating a new performance pattern in accordance with the user input and a performance pattern performed during the user input; and modifying the pattern sequence data to substitute in the pattern sequence data, an identifier of the new performance pattern for the identifier of the performance pattern from which it was created with the same attribute as the predefined attribute.

23. The automatic performance method of claim 22, wherein the predefined attribute comprises at least one of a performance pattern or a style of the sequence of performance patterns.

* * * * *